US007093799B1

(12) United States Patent
Dulat et al.

(10) Patent No.: US 7,093,799 B1
(45) Date of Patent: Aug. 22, 2006

(54) GUIDED MISSILE HAVING A JETTISONED PROTECTIVE CAP

(75) Inventors: Bernd Dulat, Überlingen (DE); Hubert Kuppel, Stockach (DE); Wolgang Grosshardt, Deggenhausertal (DE); Alexander Stengele, Stockach (DE); Jens Wallrabe, Hohenfels (DE)

(73) Assignee: Bodenseewerk Gerätetechnik GmbH, Überlingen (DE)

( * ) Notice: Subject to any disclaimer, the term of this patent is extended or adjusted under 35 U.S.C. 154(b) by 122 days.

(21) Appl. No.: 10/634,485

(22) Filed: Aug. 5, 2003

(30) Foreign Application Priority Data

Aug. 27, 2002 (DE) ..... 102 40 040

(51) Int. Cl.
*F42B 15/34* (2006.01)
*H01Q 1/42* (2006.01)
*F42B 15/00* (2006.01)

(52) U.S. Cl. ..... 244/121; 244/3.1; 244/117 R; 244/119; 244/171.7; 343/872

(58) Field of Classification Search ..... 244/3.1–3.3, 244/121, 158.1, 171.7, 171.8, 118.2, 171.1, 244/117 R, 119; 102/293, 200, 213, 225, 102/158 A, 501, 378; 343/872, 873
See application file for complete search history.

(56) References Cited

U.S. PATENT DOCUMENTS 2,655,106 A * 10/1953 O'Brien ..... 102/200
2,889,772 A * 6/1959 Howard ..... 102/200
3,336,872 A * 8/1967 Langen et al. ..... 102/200
3,362,290 A * 1/1968 Carr et al. ..... 102/378
3,453,960 A * 7/1969 Qualls ..... 102/378
3,524,608 A * 8/1970 Nicholson et al. ..... 244/121
3,601,055 A 8/1971 Crockett
3,637,166 A * 1/1972 Nicholson et al. ..... 244/121
3,674,227 A * 7/1972 Jacobson et al. ..... 244/121
3,706,281 A * 12/1972 Hatakeyama ..... 102/378
3,747,530 A * 7/1973 Tepper ..... 102/200
4,245,890 A * 1/1981 Hartman et al. ..... 244/3.16
4,275,859 A * 6/1981 Bleday ..... 244/121
4,515,082 A * 5/1985 Pizzurro ..... 102/293
4,533,094 A * 8/1985 Geis et al. ..... 244/3.22
4,690,351 A * 9/1987 Beckerleg et al. ..... 244/3.16
4,867,357 A * 9/1989 Inglis et al. ..... 244/121
5,167,386 A * 12/1992 Laquer et al. ..... 244/121
5,325,784 A * 7/1994 Bai et al. ..... 102/293
5,404,814 A * 4/1995 Fisch et al. ..... 102/293
5,529,264 A * 6/1996 Bedegrew et al. ..... 244/118.2
5,662,293 A * 9/1997 Hower et al. ..... 244/121
5,691,736 A * 11/1997 Hunn et al. ..... 244/121
5,743,492 A * 4/1998 Chan et al. ..... 244/118.2
5,820,077 A * 10/1998 Sutliff et al. ..... 244/121
6,150,974 A * 11/2000 Tasaka et al. ..... 244/3.16
6,622,971 B1 * 9/2003 Robertson ..... 244/171.1
6,679,453 B1 * 1/2004 Steiner ..... 244/121
6,854,393 B1 * 2/2005 Hazan ..... 102/501

* cited by examiner

*Primary Examiner*—Bernarr E. Gregory
(74) *Attorney, Agent, or Firm*—Scully, Scott, Murphy & Presser, P.C.

(57) ABSTRACT

A guided missile having a longitudinally extending airframe with a tip, a seeker head arranged in the tip and a window located in front of the seeker head for closing the airframe at the tip so as to protect the seeker head. A jettisonable protective cap consisting of at least two separable parts is attached to the airframe in front of the window for protection of the window.

6 Claims, 4 Drawing Sheets

GUIDED MISSILE HAVING A JETTISONED PROTECTIVE CAP

BACKGROUND OF THE INVENTION

1. Field of the Invention

The invention relates to a guided missile having at its tip a seeker head which is covered by a protective cap releasable during the flight.

Guided missiles are provided with a seeker head at their tip responsive to the radiation of a tracked target. The seeker head usually has an imaging optical system imaging an object scene comprising the target onto a detector or a reticle. From the signals at the detector control signals are derived guiding the missile to the target. Towards the front the seeker head is covered by a curved window, the dome. The dome consists of a material which is transparent for the radiation to which the detector is responsive.

2. Discussion of the Prior Art

Missiles are accelerated to very high velocities. The dome is therefore exposed to considerable mechanical and thermical stress limiting the life time of the dome and thereby of the seeker head during the flight. Therefore it is known to cover the dome at first with a protective cap. The missile is first guided close to the target by other guidance means. Then the protective cap is pyrotechnically released freeing the dome and the seeker head and the seeker head can detect the target and guide the missile to the target. It is essential that the missile is not damaged by the releasing of the protective cap or disturbed in its path.

SUMMARY OF THE INVENTION

It is an object of the invention to provide a releaseable protective cap which can be released without impairing the missile.

According to the invention this object is achieved in that the protective cap is divided along its length in at least two parts kept together by releasable connecting means and the protective cap is form-fitting connected to the airframe only in the connected state by interlocking structures of the releasing cap and the airframe of the missile.

In a first flight phase with put-on protective cap kept together by connecting means the protective cap is form-fitted held to the airframe of the missile. This is achieved without screws or the like by interlocking structures provided at the protective cap and the airframe of the missile. These structures can be for example an inwardly projecting ledge at the airframe-side edge of the protective cap interlocking with a circumferential recess in the airframe. As long as the protective cap is held together, form-fitting connection is ensured over 360°. When the connecting means are released the longitudinally divided protective cap falls apart into several segments each extending over for example 180° or 120°. Thereby the form-fitting is no longer ensured. The pressure pushes the segments in a radial direction outwards, while the interlocking structures fall apart. The segments are jettisoned to the side.

In a preferred embodiment the protective cap is cone-shaped and divided along at least two generatrices of the cone. The connecting means are preferably pyrotechnically releasable. In order to ensure safe sideways pushing of the parts of the protective cap after the release of the connecting means preferably an opening is formed in the protective cap in such a way that pressure builds up in the interior of the protective cap before the release of the connecting means. The opening can be closed by a releasable cover the cover being released shortly before the release of the connecting means. The cover can be released by pyrotechnical means.

BRIEF DESCRIPTION OF THE DRAWINGS

Embodiments of the invention are described below in greater detail with reference to the accompanying drawings.

DETAILED DESCRIPTION OF THE INVENTION

Figure 1:
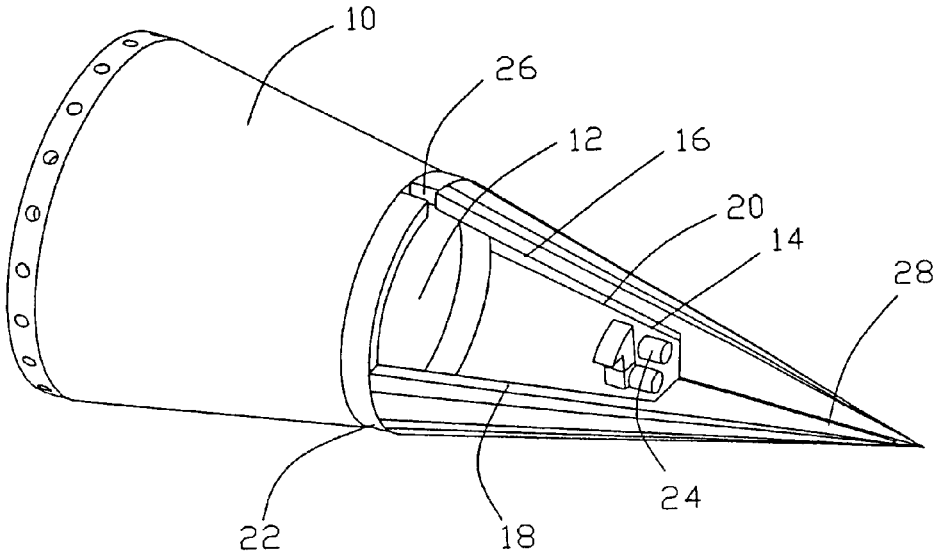
FIG. 1 is a perspective, partly sectional view of the tip of a missile with a two-part conical protective cap wherein an opening is provided in the tip of the protective cap to build up pressure within the protective cap.
Figure 2:
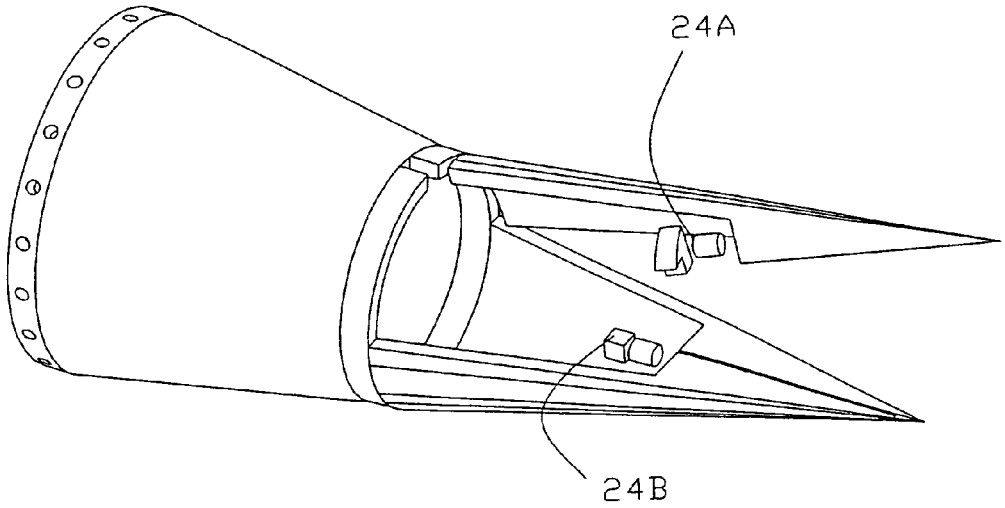
FIG. 2 is a perspective view of the arrangement of FIG. 1 and shows the release of the connecting means and the opening of the protective cap.

In FIG. 1 numeral 10 denotes the tip of a missile. The tip 10 comprises a (non-visible) seeker head, for example an infrared seeker head. The tip 10 is closed by a dome 12, i.e a curved window transparent for infrared radiation. A conical protective cap 14 is arranged in front of the dome 12 at the tip 10. The protective cap 14 is longitudinally divided along along two diametrally opposing generatrices 16 and 18 of the cone, so that two parts 20 and 22 are formed each extending over 180°. The two parts 20 and 22 are connected by connecting means 24 which are pyrotechnically releasable. By the pyrotechnical release of the connecting means 24 the two parts 20 and 22 can be separated from each other. As can be seen from FIG. 2 the connecting means 24 are divided into two halves 24A and 24B.

Figure 3:
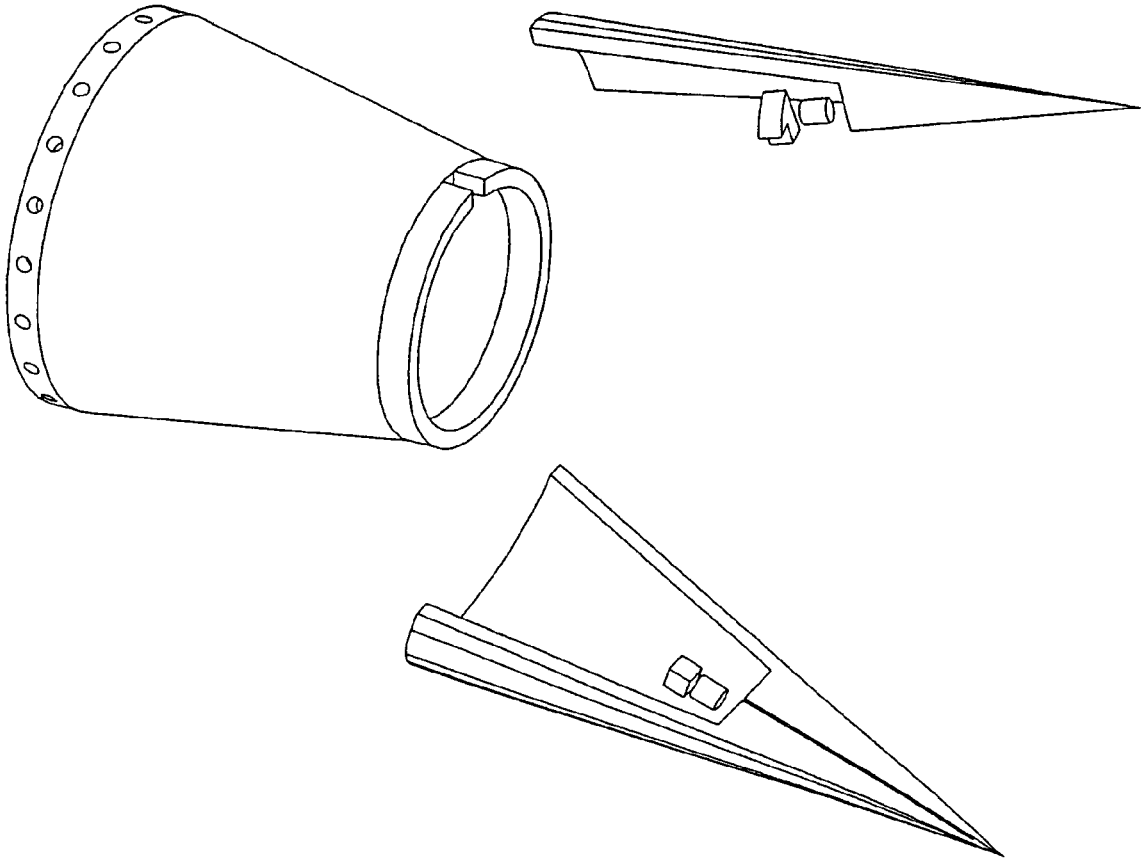
FIG. 3 is a perspective view similar to the one in FIG. 2 and shows the sideways jettisoning of the two parts of the protective cap.

As long as the protective cap 14 is not divided it is form-fitted connected to the protective cap and the airframe or tip 10 of the missile by the interlocking structures. As can be seen from FIG. 1 these structures consist of an inwardly projecting ledge 26 extending along the airframe-side edge of the protective cap 14 which interlocks with a circumferential recess at the edge of the tip 10 about an angle of 360°. If the protective cap 14 falls apart into two parts 20 and 22, with each of them extending only about an angle of 180° there is no form-fitting any longer. The two parts 20 and 22 are disengage from the tip 10 of the missile and are jettisoned to the side, as shown in FIG. 3.

To support the disengagement and the jettisoning to the side, an opening 28 is provided in the range of the tip of the cone. Through this opening a pressure builds up in the space within the protective cap 14 and in front of the dome 12. This pressure acts on the two parts 20 and 22 outwardly to the side. When the connecting means 24 are separated and the protective cap 14 is divided into its two parts 20 and 22 this pressure ensures that the parts 20 and 22 are quickly pushed away to the side.

Figure 4:
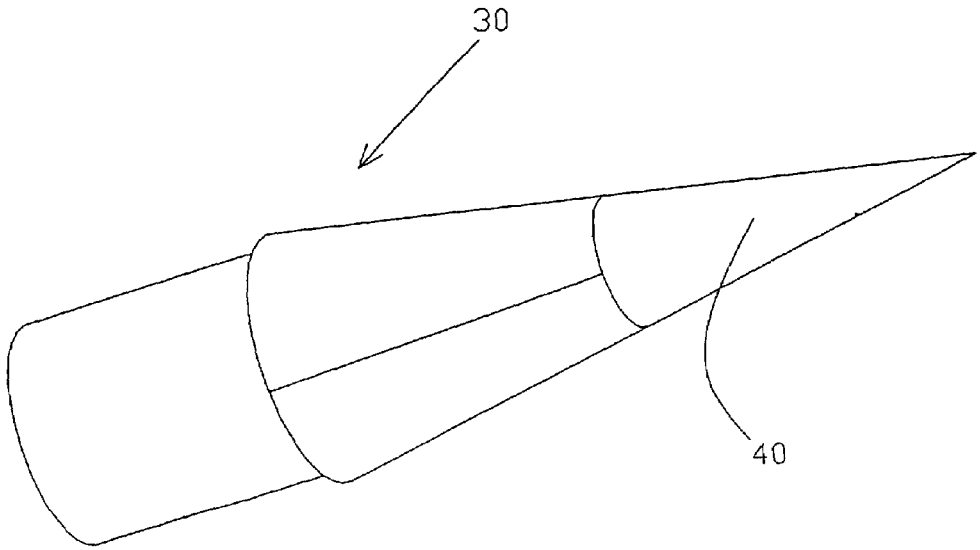
FIG. 4 is a perspective view of an alternative embodiment of a protective cap also having an opening for generating a pressure, this opening, however, being closed by a releasable cover in the form of the tip of a cone.
Figure 5:
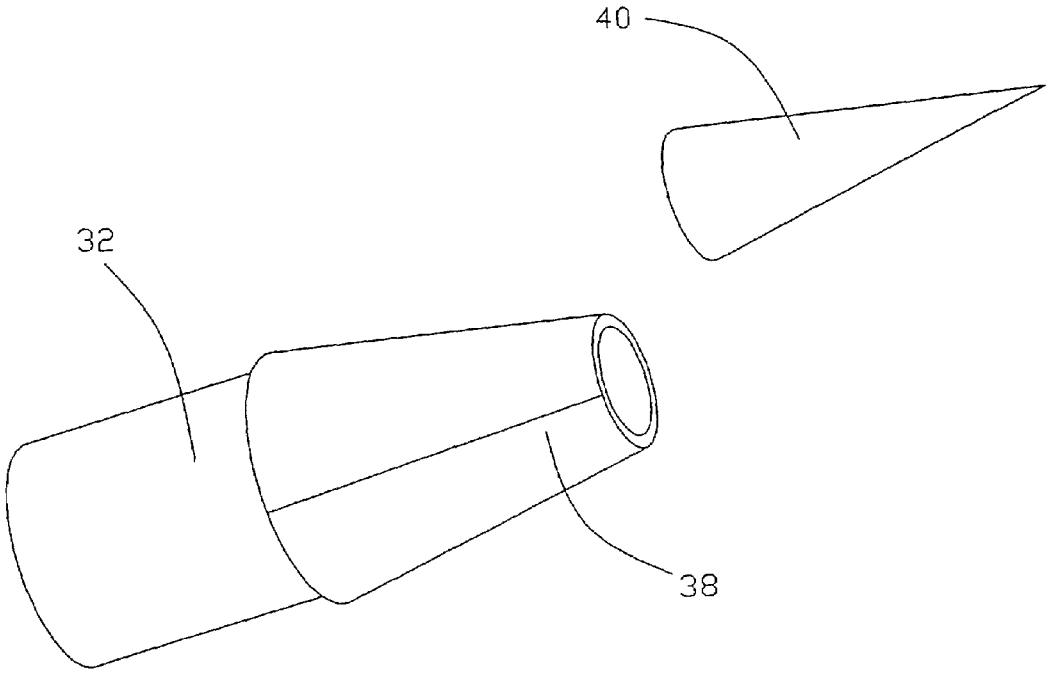
FIG. 5 is a perspective view similar to the one in FIG. 4 and illustrates the release of the tip of the cone.
Figure 6:
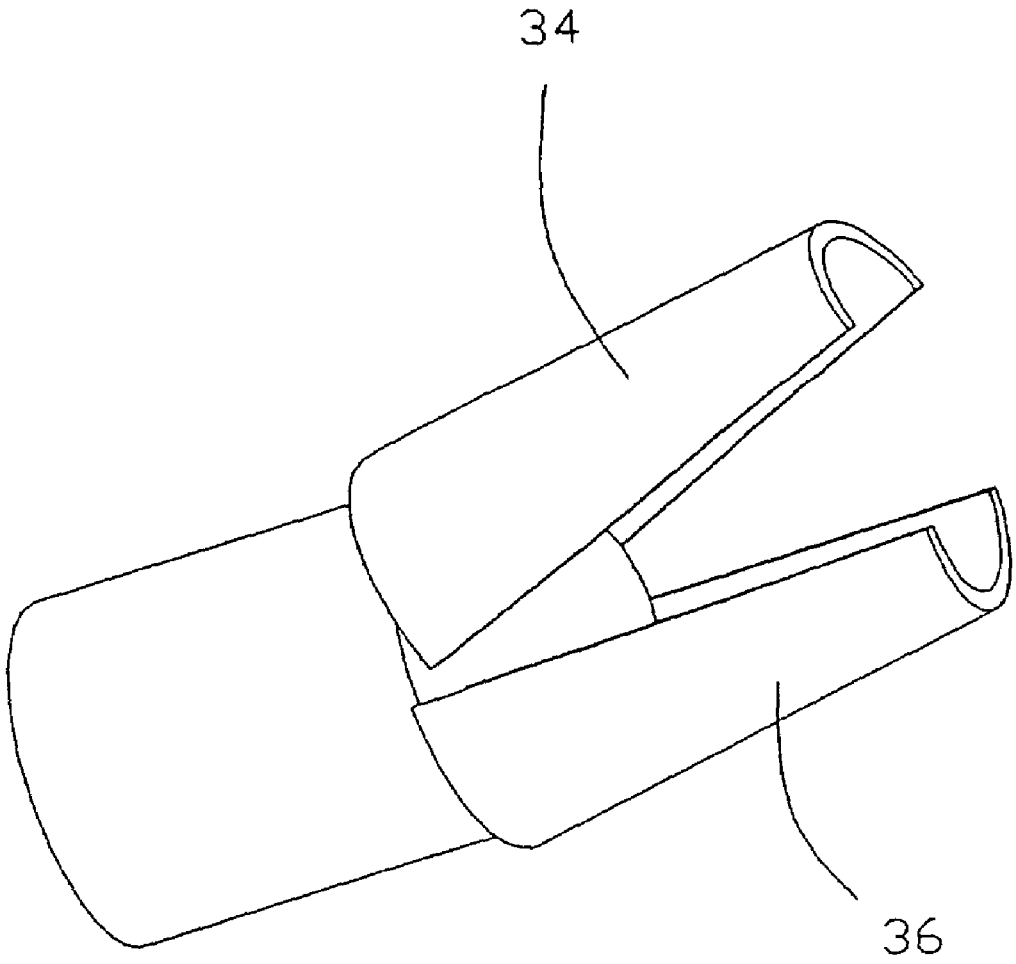
FIG. 6 is a perspective view of the protective cap of FIG. 5 and shows the dividing of the two parts of the protective cap.

FIGS. 4 to 6 show a different embodiment. Here, the cone-shaped protective cap 30 consists of three parts, i.e.

two at the tip 32 of the missile and adjacent bowl-shaped parts 34 and 36 adding up to a section of the protective cap 30 in the shape of a truncated cone and forming an opening 38 at the front and a cone-shaped cover 40 forming the tip of the cone of the protective cap 30 and covering the opening 38 and keeping the two parts 34 and 36 together at their front edge.

As it is shown in FIG. 5, at first the cover 40 is pyrotechnically blown off to jettison the protective cap 30. Thereby the opening 38 is freed. Through the opening a pressure builds up within the parts 34 and 36 trying to push the two parts apart. The parts 34 and 36 released by the cover 40 are pushed apart. The form-fitting at the rear end of the parts 34 and 36 ends so that the parts 34 and 36 are released backwards at an inclined angle.

We claim:

1. A guided missile having an airframe, said airframe defining a longitudinal axis, and a jettisonable protective cap being attached to a leading end of said airframe for protection of operative components arranged in said airframe, wherein said protective cap is longitudinally divided into at least two parts which, together, extend circumferentially through an angle of 360° about said longitudinal axis, each said part extending through an angle of not more than 180°, said at least two parts being interconnectable by connecting means, means for releasing said connecting means; said two parts together and said airframe defining a form-fitting interlocking structure along the airframe-side edge of said protective cap means only upon said two parts being in an interconnected condition, said protective cap having an opening located substantially on said longitudinal axis, said opening facilitating a dynamic pressure to be built up within said protective cap for a sideways detachment from said guided missile coupled by a release of said form-fitting interlocking structure responsive to the build up of said dynamic pressure during flight of said guided missile.

2. A guided missile as claimed in claim 1, wherein said protecting cap comprises a conical cap divided along at least two cone generatrices.

3. A guided missile as claimed in claim 1, wherein said releasing means comprise pyrotechnic releasing means.

4. A guided missile as claimed in claim 1, comprising jettisonable closure means attached to said protective cap for closing said opening, and closure member releasing means for releasing said closure means.

5. A guided missile as claimed in claim 4, wherein said protective cap is frusto-conical comprising at least two circumferentially extending parts each having a front edge and a rear edge, said rear edge adjoining the airframe front edge, and said jettisonable closure means comprise means for engaging said front edge and forming a part of said connecting means, whereby, when said closure means is jettisoned by said closure member releasing means, said dynamic pressure causes said at least two circumferentially extending parts to part sidewise, thereby facilitating release of said form-fitting interlocking structure.

6. A guided missile as claimed in claim 4, wherein said closure member releasing means comprise pyrotechnic releasing means.

* * * * *